US011145444B2

(12) United States Patent
Fujiwara et al.

(10) Patent No.: US 11,145,444 B2
(45) Date of Patent: Oct. 12, 2021

(54) R-T-B-BASED SINTERED MAGNET

(71) Applicant: TDK Corporation, Tokyo (JP)

(72) Inventors: Mariko Fujiwara, Tokyo (JP); Masashi Miwa, Tokyo (JP)

(73) Assignee: TDK Corporation, Tokyo (JP)

( * ) Notice: Subject to any disclaimer, the term of this patent is extended or adjusted under 35 U.S.C. 154(b) by 276 days.

(21) Appl. No.: 16/364,443

(22) Filed: Mar. 26, 2019

(65) Prior Publication Data

US 2019/0304639 A1 Oct. 3, 2019

(30) Foreign Application Priority Data

Mar. 28, 2018 (JP) ..... JP2018-062776

(51) Int. Cl.
*H01F 1/057* (2006.01)
*C22C 30/02* (2006.01)
(Continued)

(52) U.S. Cl.
CPC ..... *H01F 1/0577* (2013.01); *B22F 3/16* (2013.01); *B22F 3/24* (2013.01); *B22F 9/04* (2013.01); *C22C 30/02* (2013.01); *C22C 38/005* (2013.01); *B22F 2003/248* (2013.01); *B22F 2201/013* (2013.01); *B22F 2301/355* (2013.01); *C22C 2202/02* (2013.01); *H01F 1/0576* (2013.01)

(58) Field of Classification Search
None
See application file for complete search history.

(56) References Cited

U.S. PATENT DOCUMENTS 5,405,455 A * 4/1995 Kusunoki ..... C22C 1/0441 148/103
2002/0112785 A1* 8/2002 Sekine ..... B82Y 25/00 148/302

(Continued)

FOREIGN PATENT DOCUMENTS

CN 1938795 A 3/2007
CN 103582715 A 2/2014

(Continued)

OTHER PUBLICATIONS

Mazilkin, A. et al., "Grain boundary oxide layers in NdFeB-based permanent magnets", Materials and Design, vol. 199, article 109417, Available online Dec. 22, 2020.*

*Primary Examiner* — George Wyszomierski
(74) *Attorney, Agent, or Firm* — Faegre Drinker Biddle & Reath LLP

(57) ABSTRACT

An R-T-B-based sintered magnet 2 contains a rare earth element R, a transition metal element T, B, Ga, and O, the sintered magnet 2 includes a magnet body 4 and an oxidized layer 6 covering the magnet body 4, the magnet body 4 includes main phase grains 8 containing a crystal of $R_2T_{14}B$ and a grain boundary phase 1 positioned between the main phase grains 8 and containing R, the oxidized layer 6 includes a plurality of oxide phases 3A containing R, T, Ga, and O, the oxide phase 3A satisfies the following Formulas (1) and (2) regarding the content (unit: atom %) of each element, and the oxide phase 3A in the oxidized layer 6 covers the grain boundary phase 1 in the magnet body 4.

$$0.3 \leq [R]/[T] \leq 0.5 \quad (1)$$

$$0.2 \leq [O]/([R]+[T]+[Ga]+[O]) \leq 0.7 \quad (2)$$

5 Claims, 7 Drawing Sheets

(51) Int. Cl.

| | |
|---|---|
| ***B22F 9/04*** | (2006.01) |
| ***B22F 3/16*** | (2006.01) |
| ***B22F 3/24*** | (2006.01) |
| ***C22C 38/00*** | (2006.01) |

(56) References Cited

U.S. PATENT DOCUMENTS

| | | | | |
|---|---|---|---|---|
| 2005/0268989 | A1 | 12/2005 | Tomizawa et al. | |
| 2008/0050581 | A1 | 2/2008 | Miwa et al. | |
| 2012/0112862 | A1 | 5/2012 | Miwa et al. | |
| 2013/0248754 | A1* | 9/2013 | Sakuma | H01F 41/00 252/62.55 |
| 2014/0132377 | A1 | 5/2014 | Nakajima et al. | |
| 2017/0025207 | A1 | 1/2017 | Nakajima et al. | |
| 2020/0303098 | A1* | 9/2020 | Fujiwara | C22C 38/10 |

FOREIGN PATENT DOCUMENTS

| | | | |
|---|---|---|---|
| JP | 2009-260338 | A | 11/2009 |
| WO | WO-2004/081954 | A1 | 9/2004 |

* cited by examiner

R-T-B-BASED SINTERED MAGNET

TECHNICAL FIELD

The present invention relates to an R-T-B-based sintered magnet containing at least a rare earth element (R), a transition metal element (T), and boron (B).

BACKGROUND

Since R-T-B-based sintered magnets have excellent magnetic properties, the R-T-B-based sintered magnets are used for motors, actuators, or the like mounted on hybrid vehicles, electric vehicles, electronic devices, home appliances, and the like. The R-T-B-based sintered magnets used for motors and the like are required to have a high coercivity even under a high temperature environment.

As a technique for improving the coercivity (HcJ) of the R-T-B-based sintered magnet at a high temperature, techniques of improving a magnetic anisotropy of an $R_2T_{14}B$ phase by substituting a part of light rare earth elements (Nd or Pr) constituting the $R_2T_{14}B$ phase into heavy rare earth elements (Dy or Tb) have been known. In recent years, demand for high coercive type R-T-B-based sintered magnets requiring a large amount of heavy rare earth elements is rapidly expanding.

However, the heavy rare earth elements as resources are unevenly distributed in specific countries and the output of the heavy rare earth elements is limited. Therefore, the heavy rare earth elements are more expensive than the light rare earth elements, and the supply amount of the heavy rare earth elements is not stable. For this reason, the R-T-B-based sintered magnet having a high coercivity at a high temperature even when the content of the heavy rare earth elements is small has been required.

For example, the following Pamphlet of International Publication WO 2004/081954 discloses that a ratio of B in the R-T-B-based sintered magnet is lower than a stoichiometric ratio to suppress a formation of a B-rich phase ($R_{1.1}Fe_4B_4$), thereby improving a residual magnetic flux density (Br) and Ga is added to the sintered magnet to suppress a formation of a soft magnetic phase ($R_2Fe_{17}$ phase), thereby suppressing a decrease in coercivity.

Further, the following Japanese Unexamined Patent Publication No. 2009-260338 discloses that a ratio of B in the R-T-B-based sintered magnet is lower than a stoichiometric ratio and elements such as Zr, Ga, and Si are added to the sintered magnet to increase Br and suppressing variations in magnetic properties.

SUMMARY

Regardless of the presence or absence of the heavy rare earth element, the rare earth element R contained in the R-T-B-based sintered magnet is a highly reactive element and therefore tends to be oxidized. Therefore, the R-T-B-based sintered magnet essentially containing the rare earth element R is easily corroded under a high temperature or high humidity environment, and the mass of the R-T-B-based sintered magnet tends to be decreased.

An object of the present invention is to provide an R-T-B-based sintered magnet having excellent corrosion resistance.

An R-T-B-based sintered magnet according to an aspect of the present invention is an R-T-B-based sintered magnet containing a rare earth element R, a transition metal element T, B, Ga, and O, in which the R-T-B-based sintered magnet contains at least one of Nd and Pr as R, the R-T-B-based sintered magnet contains at least Fe of Fe and Co as T, the R-T-B-based sintered magnet includes a magnet body and an oxidized layer covering at least a part of the magnet body, the magnet body includes a plurality of main phase grains including a crystal of $R_2T_{14}B$ and a grain boundary phase positioned between at least two of the main phase grains and containing R, the oxidized layer includes a plurality of oxide phases containing R, T, Ga, and O, a content of R in the oxide phase is [R] atom %, a total content of Fe and Co in the oxide phase is [T] atom %, a content of Ga in the oxide phase is [Ga] atom %, and a content of O in the oxide phase is [O] atom %, the oxide phase satisfies the following Formulas (1) and (2), and at least a part of the oxide phase included in the oxidized layer covers at least a part of the grain boundary phase included in the magnet body.

$$0.3 \leq [R]/[T] \leq 0.5 \quad (1)$$

$$0.2 \leq [O]/([R]+[T]+[Ga]+[O]) \leq 0.7 \quad (2)$$

The oxide phase may further satisfy the following Formula (2-1).

$$0.4 \leq [O]/([R]+[T]+[Ga]+[O]) \leq 0.7 \quad (2\text{-}1)$$

The oxidized layer may include: the plurality of oxidized main phase grains; and a plurality of grain boundary multiple junctions which are grain boundary phases surrounded by at least three of the oxidized main phase grains, and a ratio m/M of the number m of grain boundary multiple junctions including the oxide phase with respect to the total number M of grain boundary multiple junctions exposed on a surface of the oxidized layer may be 0.2 or more and 0.7 or less.

The content of R in the R-T-B-based sintered magnet may be 30 mass % or more and 33 mass % or less, the content of B in the R-T-B-based sintered magnet may be 0.72 mass % or more and 0.95 mass % or less, and the content of Ga in the R-T-B-based sintered magnet may be 0.4 mass % or more and 1.5 mass % or less.

A content of R in the grain boundary phase included in the magnet body may be [R'] atom %, a total content of Fe and Co in the grain boundary phase included in the magnet body may be [T'] atom %, at least a part of the grain boundary phase included in the magnet body may contain R, T, and Ga, and may be a transition metal rich phase satisfying the following Formula (1'), and at least a part of the transition metal rich phase may be covered with the oxide phase.

$$0.3 \leq [R']/[T'] \leq 0.5 \quad (1')$$

According to the present invention, it is possible to provide the R-T-B-based sintered magnet having excellent corrosion resistance.

DETAILED DESCRIPTION

Figure 1A:
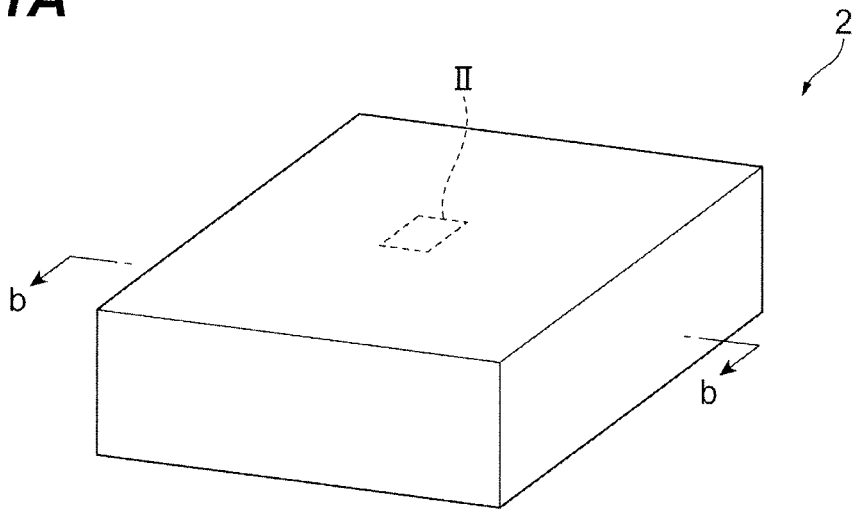
FIG. 1A is a schematic perspective view of an R-T-B-based sintered magnet according to an embodiment of the present invention.

Hereinafter, preferred embodiments of the present invention will be described with reference to the drawings. In the drawings, like components are denoted by like reference numerals. The present invention is not limited to the following embodiments. Any "sintered magnet" described below means an "R-T-B-based sintered magnet".

(Sintered Magnet)

The sintered magnet according to the present embodiment contains at least rare earth element (R), a transition metal element (T), boron (B), gallium (Ga), and oxygen (O).

The sintered magnet contains at least one of neodymium (Nd) and praseodymium (Pr) as a rare earth element R. The sintered magnet may contain both the Nd and the Pr. The sintered magnet may further contain another rare earth element R in addition to the Nd or the Pr. Other rare earth elements R may be at least one selected from the groups consisting of scandium (Sc), yttrium (Y), lanthanum (La), cerium (Ce), samarium (Sm), europium (Eu), gadolinium (Gd), terbium (Tb), dysprosium (Dy), holmium (Ho), erbium (Er), thulium (Tm), ytterbium (Yb), and lutetium (Lu).

The sintered magnet contains at least iron (Fe) of Fe and cobalt (Co) as the transition metal element T. The sintered magnet may contain both the Fe and the Co.

Figure 1B:
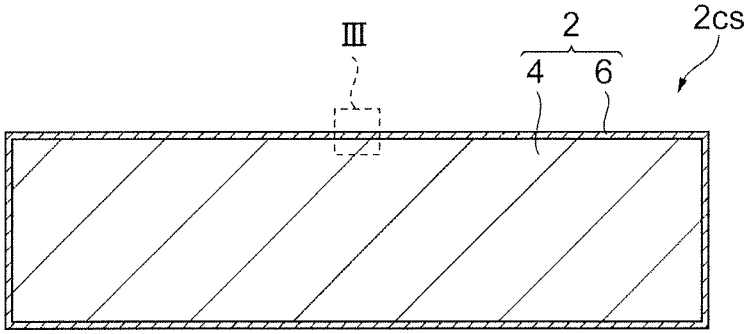
FIG. 1B is a schematic view (viewed in a direction of arrow b-b) of a cross section of the R-T-B-based sintered magnet (magnet body and oxidized layer) shown in FIG. 1A.
Figure 2:
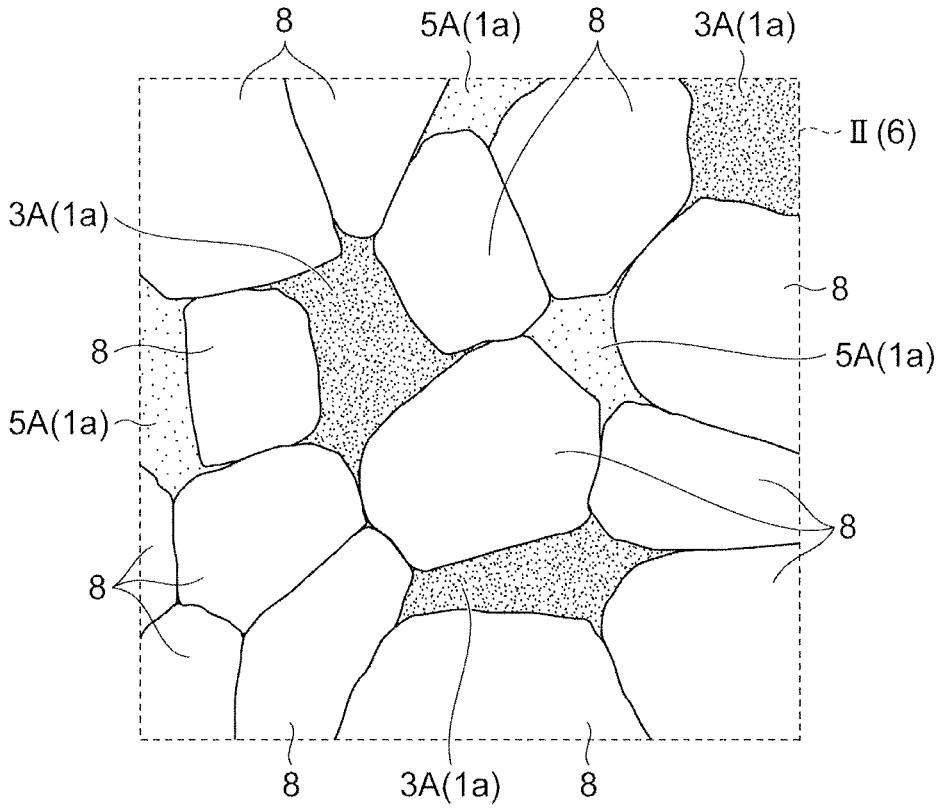
FIG. 2 is a schematic enlarged view of a part (region II) of the surface of the R-T-B-based sintered magnet (oxidized layer) shown in FIG. 1A.
Figure 3:
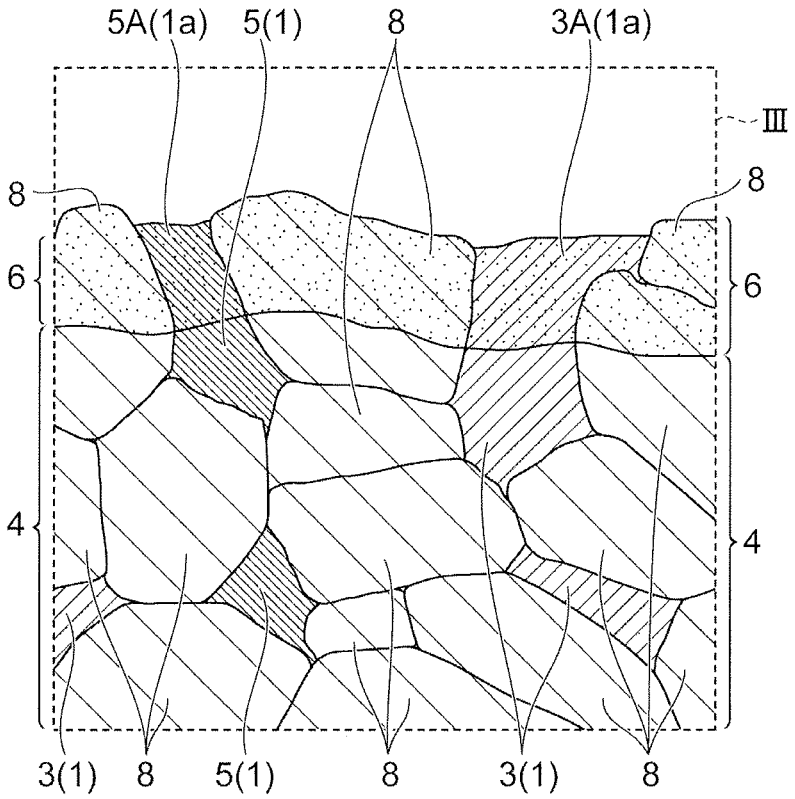
FIG. 3 is a schematic enlarged view of a part (region III) of the cross section of the R-T-B-based sintered magnet (magnet body and oxidized layer) shown in FIG. 1B.

FIG. 1A is a schematic perspective view of a rectangular parallelepiped sintered magnet 2 according to the present embodiment, FIG. 1B is a schematic diagram of a cross section 2*cs* of the sintered magnet 2. FIG. 2 is an enlarged view of a part (region II) of a surface of the sintered magnet 2 (oxidized layer 6). FIG. 3 is an enlarged view of a part (region III) of a cross section 2*cs* of the sintered magnet 2. A shape of the sintered magnet 2 is not limited to a rectangular parallelepiped. For example, the shape of the sintered magnet 2 may be one selected from the group consisting of an are segment shape, a C-letter shape, a tile shape, a flat plate, a cylinder, and an arcuate shape.

The sintered magnet 2 includes a magnet body 4 and an oxidized layer 6 covering at least a part of the magnet body 4. The sintered magnet 2 may consist of the magnet body 4 and the oxidized layer 6. The oxidized layer 6 may be paraphrased into a protective layer. As will be described below, the oxidized layer 6 is formed by oxidizing a surface of the magnet body 4 during the process of manufacturing the sintered magnet 2. Corrosion of the sintered magnet tends to progress from a grain boundary phase positioned on the surface of the magnet body. However, the magnet body 4 is covered with the oxidized layer 6, such that it is difficult for a corrosive material such as oxygen or water to penetrate into the magnet body 4 via the grain boundary phase. As a result, the corrosion of the magnet body 4 is suppressed, and the corrosion resistance of the entire sintered magnet 2 is improved. The oxidized layer 6 may cover the entire magnet body 4. The corrosion resistance of the sintered magnet 2 is further improved by covering the entire magnet body 4 with the oxidized layer 6. When the corrosion resistance is required only on a part of the surface of the sintered magnet 2, only a part of the magnet body 4 may be covered with the oxidized layer 6.

The sintered magnet 2 may further include another layer covering at least a part of the surface of the magnet body 4 or the oxidized layer 6. Another layer may be, for example, a metal layer such as a plating layer, or a resin layer.

As shown in FIG. 3, the magnet body 4 includes a plurality of (a myriad of) main phase grains 8 sintered together. The main phase grain 8 contains a crystal of $R_2T_{14}B$. The main phase grain 8 may consist of only a crystal (single crystal or polycrystal) of $R_2T_{14}B$. The main phase grain 8 may contain other elements in addition to R, T and B. A composition in the main phase grain 8 may be uniform. The composition in the main phase grain 8 may be non-uniform. For example, a concentration distribution of each of R, T and B in the main phase grain 8 may have a gradient.

The magnet body 4 includes a grain boundary phase 1 positioned between at least two main phase grains 8 and containing R. The content (unit: atom %) of R in the grain boundary phase 1 tends to be higher than the content of R in the main phase grain 8. The magnet body 4 may have a plurality of two-grain boundaries. The two-grain boundary 10 is a grain boundary phase 1 positioned between two adjacent main phase grains 8. The magnet body 4 may have a plurality of grain boundary multiple junctions. The grain boundary multiple junction is a grain boundary phase 1 surrounded by at least three main phase grains 8.

At least a part of the grain boundary phase 1 may be the transition metal rich phase 3. At least a part of the grain boundary phase 1 may be the R-rich phase 5.

The transition metal rich phase 3 contains at least R, T, and Ga, and is a grain boundary phase 1 satisfying the following Formula (1').

$$0.3 \leq [R']/[T'] \leq 0.5 \quad (1')$$

[R'] is the content of R in the grain boundary phase 1 contained in the magnet body 4. [T'] is the total content of Fe and Co in the grain boundary phase 1 contained in the magnet body 4. A unit of [R'] and [T'], respectively, are atom %. [R']/[T'] in the transition metal rich phase 3 is smaller than [R']/[T'] in the R-rich phase 5. The transition metal rich phase 3 may contain only Fe of Fe and Co as T. The transition metal rich phase 3 may contain both the Fe and the Co as T.

The magnet body 4 contains Ga, such that the transition metal rich phase 3 satisfying the above formula (1') tends to be formed. That is, the magnet body 4 contains Ga, such that the transition metal rich phase 3 containing a relatively larger amount of T than R is easily formed. In the conventional R-T-B-based sintered magnet not containing Ga, the transition metal rich phase 3 satisfying the above formula (1') is hardly formed.

The transition metal rich phase 3 may be a phase containing $R_6T_{13}Ga$. The transition metal rich phase 3 may be a phase consisting of only the $R_6T_{13}Ga$. The $R_6T_{13}Ga$ may be, for example, $Nd_6Fe_{13}Ga$. The magnet body 4 contains the transition metal rich phase 3, such that a coercivity of the sintered magnet 2 tends to be improved.

The R-rich phase 5 is the grain boundary phase 1 containing at least R. [R']/[T'] in the R-rich phase 5 is higher than [R']/[T'] in the transition metal rich phase 3. That is, [R']/[T'] in the R-rich phase 5 is larger than 0.5. The R-rich phase 5 may contain only Fe of Fe and Co as the transition metal element T. The R-rich phase 5 may contain both the Fe and the Co as the transition metal element T. The R-rich phase 5 may not contain the transition metal element T. The R-rich phase 5 may contain O. The R-rich phase 5 may not contain O.

The rare earth element R is more easily oxidized as compared with the transition metal element T. Therefore, the R-rich phase 5 having the high ratio of the content of R with respect to the content of T is more easily oxidized than the transition metal rich phase 3. However, since the magnet body 4 includes, as the grain boundary phase 1, not only the R-rich phase 5 but also the transition metal rich phase 3 which is harder to be oxidized than the R-rich phase 5, the oxidation of the grain boundary phase 1 tends to be suppressed, and the corrosion of the magnet body 4 through the grain boundary phase 1 tends to be suppressed.

A part of the grain boundary phase 1 may be other phases different from the transition metal rich phase 3 and the R-rich phase 5. The other phase may be, for example, a rare earth oxide phase. The rare earth oxide phase is a phase containing an oxide of R or a phase consisting of only an oxide of R. The content of O in the grain boundary phase 1 contained in the magnet body 4 is represented by [0'] atom %, and [O']/[R'] in the rare earth oxide phase is larger than [O']/[R'] in the R-rich phase 5.

The oxidized layer 6 includes a plurality of oxide phases 3A containing R, T, Ga, and O. The content of R in the oxide phase 3A is [R] atom %. The total content of Fe and Co in the oxide phase 3A is [T] atom %. The content of Ga in the oxide phase 3A is [Ga] atom %. The content of O in the oxide phase 3A is [O] atom %. The oxide phase 3A satisfies the following Formulas (1) and (2). At least a part of the oxide phase 3A contained in the oxidized layer 6 covers at least a part of the grain boundary phase 1 included in the magnet body 4.

$$0.3 \leq [R]/[T] \leq 0.5 \quad (1)$$

$$0.2 \leq [O]/([R]+[T]+[Ga]+[O]) \leq 0.7 \quad (2)$$

The oxide phase 3A is formed by oxidizing at least a part of the transition metal rich phase 3 positioned in the vicinity of the surface of the magnet body 4. As described above, the rare earth element R tends to be oxidized as compared with the transition metal element T, and the transition metal rich phase 3 having a low ratio of the content of R with respect to the content of T is harder to be oxidized than the R-rich phase 5. The oxide phase 3A formed by the oxidation of the transition metal rich phase 3 has higher stability and better corrosion resistance against corrosive substance than the R-rich phase 5. In addition, the oxide phase 3A formed by the oxidation of the transition metal rich phase 3 has higher stability and better corrosion resistance against corrosive substance than the R-rich oxide phase 5A formed by the oxidation of the R-rich phase 5. As described above, the oxide phase 3A having excellent corrosion resistance covers the grain boundary phase 1 included in the magnet body 4, such that the penetration of the corrosive substances such as oxygen, water, and the like into the magnet body 4 through the grain boundary phase 1 is suppressed. As a result, the corrosion of the grain boundary phase 1 of the magnet body and the main phase grain 8 is suppressed, and the corrosion resistance of the entire sintered magnet 2 is improved.

The range of [R]/[T] means the range of the composition of the oxide phase 3A formed by the oxidation of the transition metal rich phase 3, for example. When [R]/[T] is too large, the ratio of the content of R which tends to be oxidized is increased, and it is difficult for the oxide phase 3A to have sufficient corrosion resistance. Since the oxide phase 3A in the oxidized layer 6 is formed by the oxidation of the transition metal rich phase 3 in the magnet body 4, in order to form the oxide phase 3A having a small [R]/[T], the content of R in the magnet body 4 needs to be decreased. However, when the content of R in the magnet body 4 is too small, it is difficult for the sintered magnet 2 to have sufficient magnetic properties. That is, when [R]/[T] is too small, the content of R in the magnet body 4 is too small, such that it is difficult for the sintered magnet 2 to have sufficient magnetic properties.

When [O]/([R]+[T]+[Ga]+[O]) is too small, since the oxide phase 3A is not sufficiently oxidized, it is difficult for the oxide phase 3A to have sufficient corrosion resistance. For example, when [O]/([R]+[T]+[Ga]+[O]) is 0.05 or less, the oxidized layer 6 is substantially the same as a natural oxide film formed on the surface of the magnet body 4, and it is difficult to sufficiently suppress the corrosion of the sintered magnet 2. In other words, unless the surface of the magnet body 4 is positively oxidized, it is difficult to form the oxidized layer 6 in which [O]/([R]+[T]+[Ga]+[O]) is 0.2 or more. When [O]/([R]+[T]+[Ga]+[O]) is too large, the magnet body 4 itself is excessively oxidized with the formation of the oxidized layer 6 and the magnetic properties (for example, coercivity) of the sintered magnet 2 are damaged.

Since the corrosion resistance of the sintered magnet 2 tends to be improved, the oxide phase may further satisfy the following formula (1-1).

$$0.32 \leq [R]/[T] \leq 0.48 \quad (1\text{-}1)$$

Since the corrosion resistance of the sintered magnet 2 tends to be improved, the oxide phase may further satisfy the following formula (2-1) or (2-2).

$$0.4 \leq [O]/([R]+[T]+[Ga]+[O]) \leq 0.7 \quad (2\text{-}1)$$

$$0.45 \leq [O]/([R]+[T]+[Ga]+[O]) \leq 0.59 \quad (2\text{-}2)$$

As shown in FIG. 3, the oxidized layer 6 has the plurality of oxidized main phase grains 8 and a plurality of grain boundary multiple junctions 1*a* which are grain boundary phases surrounded by at least three oxidized main phase grains 8. A ratio (m/M) of the number m of the grain boundary multiple junctions 1*a* including the oxide phase 3A among all the grain boundary multiple junctions 1*a* (M grain boundary multiple junctions 1*a*) exposed on the surface of the oxidized layer 6 may be 0.2 or more and 0.7 or less. In other words, the magnet body 4 may include a plurality of grain boundary multiple junctions which are the grain boundary phases 1 surrounded by at least three main phase grains 8, and the ratio of the number of grain boundary multiple junctions covered with the oxide phase 3A in the oxidized layer 6 among the grain boundary multiple junctions positioned on the surface of the magnet body 4 may be 0.2 or more and 0.7 or less.

As the ratio (m/M) of the number of oxide phases 3A occupied at all the grain boundary multiple junctions 1*a* exposed on the surface of the oxidized layer 6 is increased, the grain boundary multiple junctions (grain boundary phases 1) positioned on the surface of the magnet body 4 is easily covered with the oxide phase 3A in the oxidized layer 6. As described above, the oxide phase 3A formed by the oxidation of the transition metal rich phase 3 is harder to be oxidized and has better corrosion resistance than other grain boundary multiple junctions such as the R-rich oxide phase 5A. Therefore, as the ratio (m/M) of the number of grain boundary multiple junctions (grain boundary phase 1) covered with the oxide phase 3A to the surface of the magnet body 4 is increased, the corrosion resistance of the sintered magnet 2 tends to be improved.

As shown in FIG. 3, at least a part or the whole of the transition metal rich phase 3 positioned on the surface of the magnet body 4 may be covered with the oxide phase 3A in the oxidized layer 6. The oxide phase 3A is formed by the oxidation of at least a part of the transition metal rich phase 3 on the surface of the magnet body 4. As a result, the transition metal rich phase 3 is easily covered with the oxide phase 3A. As described above, since any of the transition metal rich phase 3 and the oxide phase 3A are more excellent in corrosion resistance than the R-rich phase 5 and the R-rich oxide phase 5A, the structure in which the oxide phase 3A is covered with the transition metal rich phase 3 exists in the vicinity of the surface of the sintered magnet 2, such that the corrosion resistance of the sintered magnet 2 tends to be improved.

As described above, the oxidized layer 6 may include phases different in composition from the oxide phase 3A as the grain boundary phase. For example, the oxidized layer 6 may include the R-rich oxide phase 5A in addition to the oxide phase 3A as the grain boundary phase. (see FIG. 3). The R-rich oxide phase 5A is formed by the oxidation of the R-rich phase positioned on the surface of the magnet body 4.

The part oxidized in one main phase grain 8 (main phase oxide) may belong to the oxidized layer 6. The part not oxidized in one main phase grain 8 may belong to the magnet body 4. The oxidized layer 6 may contain the main phase grains 8 oxidized as a whole.

An average grain size of the main phase grains 8 is not particularly limited but may be, for example, 1 μm or more and 10 μm or less. A total value of the ratio of the volume of the main phase grain 8 in the sintered magnet 2 is not particularly limited, but may be, for example, 85 vol % or more and less than 100 vol %.

The thickness of the oxidized layer 6 may be, for example, 0.1 μm or more and 5 μm or less. The thicker the oxidized layer 6, the more the corrosion resistance of the sintered magnet 2 is improved, but the thicker the oxidized layer 6, the more easily the magnetic properties of the sintered magnet 2 is damaged.

The compositions of the main phase grain 8, the grain boundary phase 1 of the magnet body 4, and the grain boundary phase (for example, grain boundary multiple junction 1*a*) of the oxidized layer 6 may be specified by analyzing the surface of the sintered magnet 2 or the section 2*cs* using an energy dispersive X-ray spectroscopy (EDS) apparatus.

The main phase grains 8, the transition metal rich phase 3, and the R-rich phase 5 included in the magnet body 4 are objectively and clearly distinguished based on the difference in compositions. The main phase grain 8, the transition metal rich phase 3, and the R-rich phase 5 are also distinguished based on a color contrast even in the image of the cross section 2*cs* of the sintered magnet 2 (cross section of the magnet body 4) taken by a scanning electron microscope (SEM). There is a tendency that only one of the transition metal rich phase 3, the R-rich phase 5, and other phases exists at one two-grain boundary or one grain boundary multiple junction included in the magnet body 4. However, two or more phases of the transition metal rich phase 3, the R-rich phase 5, and other phases may exist at one two-grain boundary or one grain boundary multiple junction included in the magnet body 4.

Figure 6:
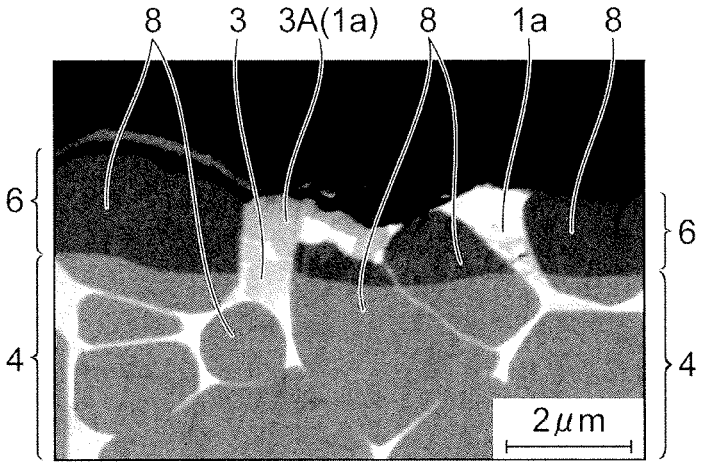
FIG. 6 is a photograph (photograph taken by a scanning electron microscope) of a cross section of the R-T-B-based sintered magnet (oxidized layer and magnet) of Example 4 of the present invention.

The magnet body 4 and the oxidized layer 6 are objectively and clearly distinguished based on the difference in compositions. As shown in FIG. 6, the magnet body 4 and the oxidized layer 6 are distinguished based on the color contrast even in the image of the cross section 2*cs* of the sintered magnet 2 taken by the SEM.

The main phase grain 8 (main phase oxide), the oxide phase 3A, and the R-rich oxide phase 5A included in the oxidized layer 6 are objectively and clearly distinguished based on the difference in compositions. The oxidized main phase grain 8, the oxide phase 3A, and the R-rich oxide phase 5A are distinguished based on the color contrast even in the image of the surface or the cross section 2*cs* of the sintered magnet 2 taken by the SEM. There is a tendency that only one of the oxide phase 3A, the R-rich oxide phase 5A, and other phases exists at one two-grain boundary or one grain boundary multiple junction included in the oxidized layer 6. However, two or more phases of the oxide phase 3A, the R-rich oxide phase 5A, and other phases may exist at one two-grain boundary or one grain boundary multiple junction included in the oxidized layer 6.

The specific composition of the entire sintered magnet 2 will be described below. However, the composition range of the sintered magnet 2 is not limited to the following. The composition of the sintered magnet 2 may be out of the following composition range as long as the effect of the present invention resulting from the oxide phase 3A in the above-described oxidized layer 6 can be obtained.

The content of R in the sintered magnet may be 30 to 33 mass %. When the sintered magnet contains a heavy rare earth element as R, the total content of all rare earth elements including the heavy rare earth elements may be 30 to 33 mass %. When the content of R is in this range, each of the magnet body and the oxidized layer tends to have the above-mentioned characteristics and the high residual magnetic flux density and the coercivity tend to be obtained. When the content of R is too small, it is difficult to form the main phase grains ($R_2T_{14}B$), such that an a-Fe phase having soft magnetic properties tends to be formed and the coercivity tends to be decreased. On the other hand, when the content of R is too large, the volume ratio of the main phase grains tends to be decreased and the residual magnetic flux density tends to be decreased. Since the volume ratio of the main phase grains is increased and the residual magnetic flux density tends to increase, the content of R may be 30.0 to 32.5 mass %. Since the residual magnetic flux density and the coercivity tend to be increased, the total ratio of Nd and Pr occupied in the total rare earth element R may be 80 to 100 atom % or 95 to 100 atom %.

The content of B in the sintered magnet may be 0.72 to 0.95 mass %. Since the content of B is smaller than the stoichiometric ratio of the composition of the main phase represented by $R_2T_{14}B$ and is in the above range, the formation of the B-rich phase is suppressed, the transition metal rich phase (for example, $R_6T_{13}Ga$) satisfying the above formula (1') tends to be formed, and the oxide phase satisfying the above formulas (1) and (2) tends to be formed. As a result, the corrosion resistance and the residual magnetic flux density of the sintered magnet tend to be improved. When the content of B is too small, the $R_2T_{17}$ phase tends to be deposited and the coercivity tends to be decreased. On the other hand, when the content of B is too large, it is difficult to form the transition metal rich phase (for example, $R_6T_{13}Ga$) satisfying the above formula (1'), and it is difficult to form the FP 19-0094-0 US-TDK oxide phase satisfying the above formulas (1) and (2). In addition, when the content of B is too large, the coercivity tends to be decreased. Since the residual magnetic flux density and the coercivity tend to be increased, the content of B may be 0.75 to 0.93 mass %.

The content of aluminum (Al) in the sintered magnet may be 0 to 1.0 mass % or 0.2 to 0.5 mass %. The content of Cu in the sintered magnet may be 0 to 1.0 mass % or 0.2 to 0.5 mass %. When the content of Al and Cu, respectively, is in the above ranges, each of the magnet body and the oxidized layer is easy to have the above-mentioned characteristics, and the coercivity, the corrosion resistance, and the temperature characteristics of the sintered magnet tend to be improved.

The content of Co in the sintered magnet may be 0 to 3.0 mass % or 0.5 to 2.0 mass %. Like Fe, Co may be the transition metal element T constituting the main phase grain (crystal grain of $R_2T_{14}B$). The sintered magnet contains Co, such that a curie temperature of the sintered magnet tends to be improved. The sintered magnet contains Co, such that the corrosion resistance of the grain boundary phase tends to be improved and the corrosion resistance of the entire sintered magnet tends to be improved. In particular, when the content of Co is 0.5 to 2.0 mass %, the magnet body and the oxidized layer are easy to have the above-mentioned characteristics, and the corrosion resistance of the sintered magnet tends to be improved.

The content of Ga may be 0.1 to 5.0 mass %. When the content of Ga is 0.1 to 5.0 mass %, it is easy to form the transition metal rich phase (for example, $R_6T_{13}Ga$) satisfying the above formula (1') and the oxide phase satisfying the above formulas (1) and (2). As a result, the corrosion resistance and the residual magnetic flux density of the sintered magnet tend to be improved. On the other hand, when the content of Ga is too small, it is difficult to form the transition metal rich phase (for example, $R_6T_{13}Ga$) satisfying the above formula (1'), and it is difficult to form the oxide phase satisfying the above formulas (1) and (2). In addition, when the content of Ga is too small, the coercivity tends to be decreased. When the content of Ga is too large, the saturation magnetization is decreased and the residual magnetic flux density tends to be decreased. Since the residual magnetic flux density and the coercivity tend to be increased, the content of Ga may be 0.4 to 1.5 mass %.

The sintered magnet may also contain carbon (C). The content of C in the sintered magnet may be 0.05 to 0.3 mass %. When the content of C is too small, the coercivity tends to be decreased. When the content of C is too large, the squareness ratio (Hk/HcJ) tends to be decreased. Hk is a magnetic field corresponding to 90% of the residual magnetic flux density Br. Since the coercivity and the squareness ratio tend to be improved, the content of C may be 0.1 to 0.25 mass %.

The content of O in the sintered magnet may be 0.03 to 0.4 mass %. When the content of O is too small, the corrosion resistance of the sintered magnet tends to be decreased. When the content of O is too large, the coercivity tends to be decreased. Since the corrosion resistance and the coercivity tend to be increased, the content of O may be 0.05 to 0.3 mass % or 0.05 to 0.25 mass %.

The sintered magnet may also contain nitrogen (N). The content of N in the sintered magnet may be 0 to 0.15 mass %. When the content of N is too large, the coercivity tends to be decreased.

The balance obtained by removing the above elements from the sintered magnet may be Fe alone or Fe and other elements. In order for the sintered magnet to have sufficient magnetic properties, the total content of elements other than Fe in the balance may be 5 mass % or less with respect to the total mass of the sintered magnet.

The sintered magnet may contain, for example, zirconium (Zr) as the balance (other elements). The content of Zr in the sintered magnet may be 0 to 1.5 mass %, 0.03 to 0.25 mass %. Zr suppresses the abnormal growth of the main phase grains (crystal grains) during the manufacturing process (sintering step) of the sintered magnet and makes the structure of the sintered magnet uniform and fine, thereby making it possible to improve the magnetic properties of the sintered magnet.

The sintered magnet may contain at least one selected from the group consisting of manganese (Mn), calcium (Ca), nickel (Ni), silicon (Si), chlorine (Cl), sulfur (S), and fluorine (F) as inevitable impurities. The total value of the content of the inevitable impurities in the sintered magnet may be 0.001 to 0.5 mass %.

The sintered magnet 2 having the technical features described above can have the sufficiently high coercivity at a high temperature even when the sintered magnet 2 does not contain heavy rare earth elements. However, in order to further increase the coercivity of the sintered magnet 2 at a high temperature, the sintered magnet 2 may contain heavy rare earth elements. For example, the total content of the heavy rare earth elements in the sintered magnet 2 may be 0 mass % or more and 1.0 mass % or less. The heavy rare earth element is at least one selected from the group consisting of gadolinium (Gd), terbium (Tb), dysprosium (Dy), holmium (Ho), erbium (Er), thulium (Tm), ytterbium (Yb), and lutetium (Lu).

The composition of the entire sintered magnet may be specified by, for example, a fluorescent X-ray (XRF) analysis method, a high frequency inductively coupled plasma (ICP) emission spectrometry method, and an inert gas fusion-non-dispersive infrared absorption (NDIR) method.

The sintered magnet according to the present embodiment may be applied to a motor, an actuator or the like. For example, the sintered magnet may be used in various fields such as a hybrid vehicle, an electric vehicle, a hard disk drive, a magnetic resonance imaging (MRI) apparatus, a smartphone, a digital camera, a slim-type TV, a scanner, an air conditioner, a heat pump, a refrigerator, a vacuum cleaner, a wash dryer, an elevator, and a wind power generator.

(Method of Manufacturing Sintered Magnet)

Hereinafter, a method of manufacturing the above-described sintered magnet will be described.

A raw material alloy is prepared from a raw material metal containing each element constituting the sintered magnet by a strip casting method or the like. The raw material metal may contain at least rare earth element R, transition metal element T, B, and Ga. The raw material metal may be, for example, a simple substance of a rare earth element (metal simple substance), an alloy containing a rare earth element, pure iron, ferroboron, or an alloy containing these. These raw material metals are weighed to match the composition of the desired sintered magnet. As the raw material alloy, a plurality of alloys having different compositions may be prepared.

The raw material alloy is pulverized to prepare a raw material alloy powder. The raw material alloy may be pulverized in two steps of a coarsely pulverizing step and a finely pulverizing step. In the coarsely pulverizing step, for example, a pulverization method such as a stamp mill, a jaw crusher, a brown mill, or the like may be used. The coarsely pulverizing step may be performed under an inert gas atmosphere. After hydrogen is stored into the raw material alloy, the raw material alloy may be pulverized. That is, hydrogen storage pulverization may be performed as the coarsely pulverizing step. In the coarsely pulverizing step, the raw material alloy is pulverized until the particle size of the raw material alloy becomes about several hundred m. In the finely pulverizing step subsequent to the coarsely pulverizing step, the raw material alloy that has undergone the coarsely pulverizing step is further pulverized until the average particle size of the raw material alloy reaches 1 to 10 m. In the finely pulverizing step, for example, a jet mill may be used.

The raw material alloy may not be pulverized in two steps of the coarsely pulverizing step and the finely pulverizing step. For example, only the finely pulverizing step may be performed. In addition, when plural kinds of raw material alloys are used, each raw material alloy may be pulverized separately and then mixed.

The raw material alloy powder obtained by the above method is pressed in a magnetic field to obtain a green compact. For example, the raw material alloy powder is pressurized in a mold while applying a magnetic field to the material alloy powder in the mold to obtain the green compact. The pressure applied to the raw material alloy powder by the mold may be 30 to 300 MPa. The intensity of the magnetic field applied to the raw material alloy powder may be 950 to 1600 kA/m.

In the sintering step, the above-mentioned green compact is sintered under a vacuum or inert gas atmosphere to obtain a sintered body. The sintering conditions may be appropriately set depending on the intended composition of the sintered magnet, the pulverization method of the raw material alloy, the particle size, and the like. The sintering temperature Ts may be, for example, 1000 to 1100° C. The sintering time may be 1 to 24 hours.

As described below, the characteristic oxidized layer of the sintered magnet according to the present embodiment is formed by a two-stage aging treatment step after a sintering step, a cleaning step after the aging treatment step, an oxidation heat treatment step after the cleaning step. In order to certainly form the oxide phase satisfying the above-mentioned formulas (1) and (2) and to further improve the corrosion resistance of the sintered magnet, it is preferable to perform the two-stage aging treatment step after the sintering step, the cleaning process after the aging step, a crack introduction heat treatment step after the cleaning step, and the oxidation heat treatment step after the crack introduction heat treatment step. After the aging treatment step, the dimension of the magnet body is adjusted by machining the magnet body and then the cleaning treatment step may be performed. Hereinafter, the steps from the aging treatment step to the oxidation heat treatment step will be described with reference to FIGS. 4A, 4B, 4C, and 4D.

Figure 4A:
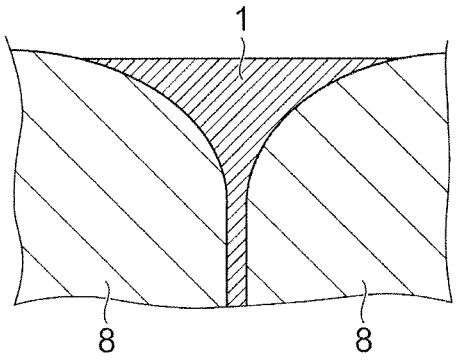
FIGS. 4A, 4B, 4C, and 4D are schematic views showing a process of forming an oxidized layer and an oxide phase of an R-T-B-based sintered magnet.

FIG. 4A is a cross section in the vicinity of the surface of the magnet body which is subjected to a first aging treatment performed after the sintering step. The magnet body subjected to the first aging treatment includes the main phase grains 8 and the grain boundary phase 1 positioned between the main phase grains 8.

Figure 4B:
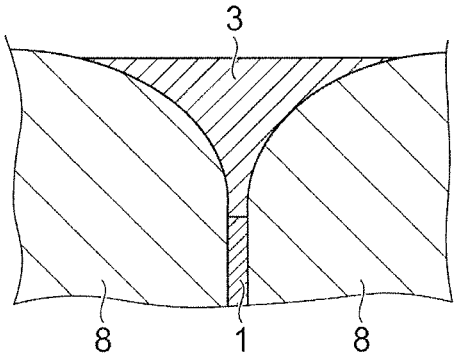

FIG. 4B is a cross section of the vicinity of the surface of the magnet body subjected to the second aging treatment subsequent to the first aging treatment. In the second aging treatment, at least a part of the grain boundary phase 1 exposed on the surface of the magnet body becomes the transition metal rich phase 3 (for example, $R_6T_{13}Ga$).

Figure 4C:
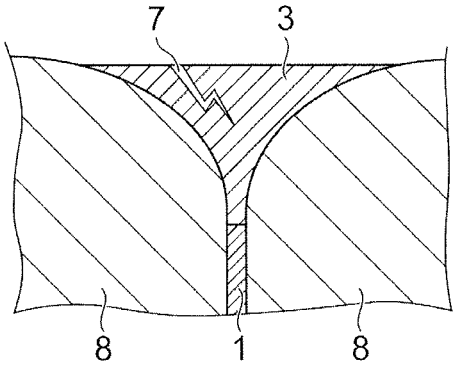
Figure 4D:
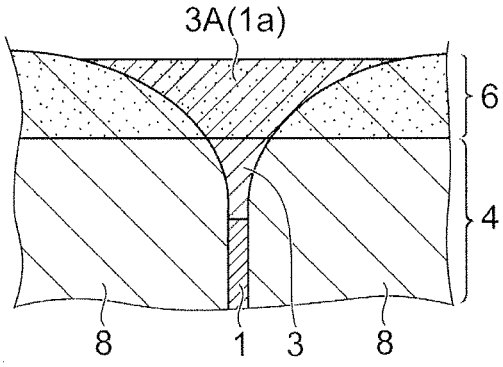

In the cleaning step, the surface of the magnet body subjected to the second aging treatment is cleaned. In the oxidation heat treatment step after the cleaning step, the surface of the magnet body is oxidized while heating the cleaned magnet body. As a result, as shown in FIG. 4D, the oxidized layer 6 covering the surface of the magnet body 4 is formed. The oxidized layer 6 includes the oxide phase 3A formed by the oxidation of the transition metal rich phase 3 exposed on the surface of the magnet body 4. This oxide phase 3A covers the grain boundary phase 1 (for example, transition metal rich phase 3 remaining on the surface of the magnet body 4 without being oxidized) contained in the magnet body 4.

As described above, the transition metal rich phase 3 is hardly oxidized as compared with the R-rich phase 5 having a large content of R. Therefore, in order to certainly oxidize the transition metal rich phase 3 and form the oxidized layer 6 having a sufficient thickness, it is preferable that the crack introduction heat treatment step is performed after the cleaning step and the oxidation heat treatment step is performed after the crack introduction heat treatment step. As shown in FIG. 4C, in the crack introduction heat treatment step, fine cracks 7 extending inwardly from the surface of the transition metal rich phase 3 are formed. After the crack introduction heat treatment step, the surface of the magnet body is oxidized in the oxidation heat treatment step. In the oxidation heat treatment step, oxygen is easily introduced into the cracks 7 formed in the transition metal rich phase 3, such that not only the surface of the transition metal rich phase 3 but also the inside thereof tend to be oxidized. As a result, the oxide phase 3A tends to be formed, the oxidized layer 6 having a sufficient thickness tends to be formed, and the grain boundary phase 1 (for example, the transition metal rich phase 3) in the magnet body 4 tends to be covered with the oxide phase 3A in the oxidized layer 6. If the thick oxidized layer 6 is formed without going through the crack introduction heat treatment step, the magnet body 4 itself tends to be excessively oxidized in the oxidation heat treatment step and the magnetic properties (for example, coercivity) of the sintered magnet tend to be damaged. In other words, in order to form the sufficiently thick oxidized layer 6 by promoting the oxidation of the transition metal rich phase 3 while suppressing the magnet body 4 from being excessively oxidized, it is preferable to form the cracks 7 in the transition metal rich phase 3 by the crack introduction heat treatment step.

Figure 5:
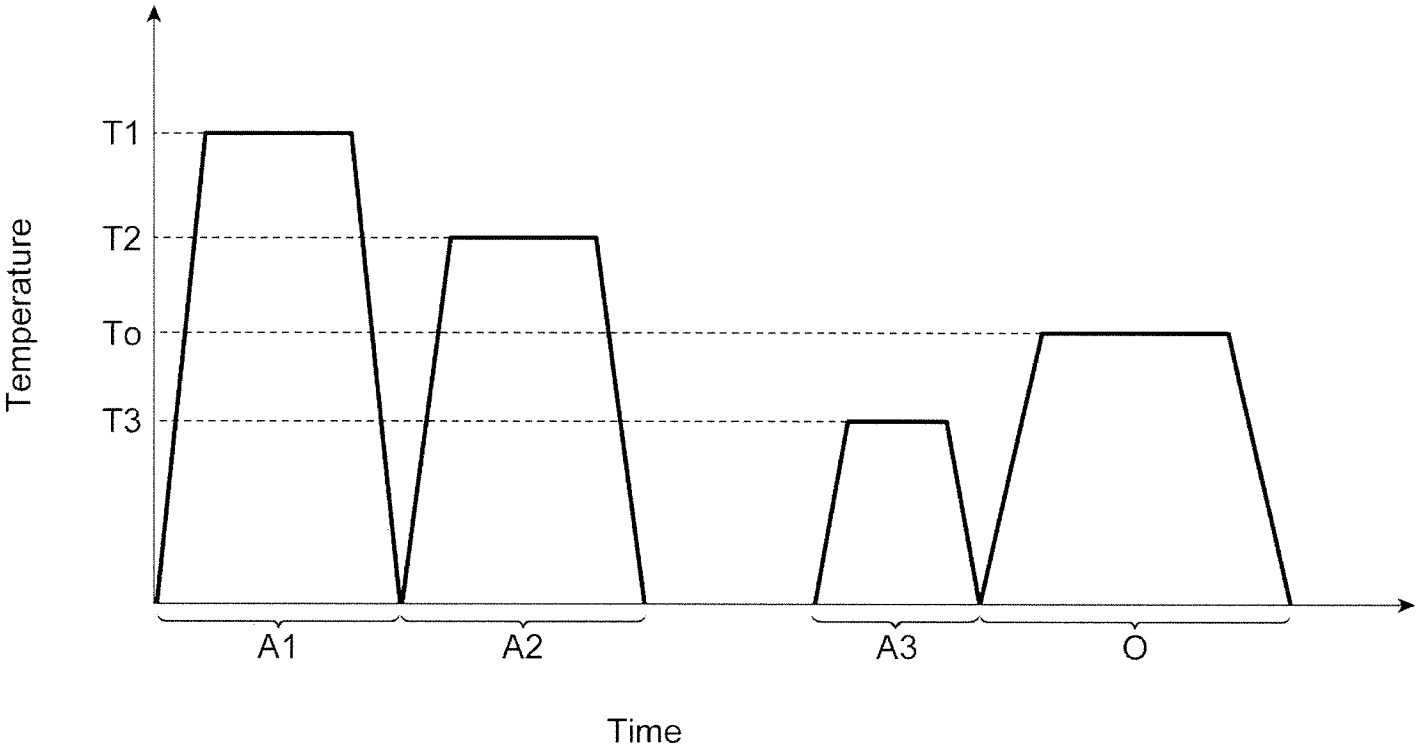
FIG. 5 is a diagram showing a temperature profile along time series of aging treatment steps, a crack introduction heat treatment step, and an oxidation heat treatment step performed in the method of manufacturing an R-T-B-based sintered magnet.

The profiles along time series of the temperatures of the aging treatment step, the crack introduction heat treatment step, and the oxidation heat treatment step are shown in FIG. 5. Details of the aging treatment step, the crack introduction heat treatment step, and the oxidation heat treatment step are as follows.

In the two-stage aging treatment step, the magnet body is heated under the vacuum or inert gas atmosphere. The inert gas atmosphere may be a noble gas such as argon (Ar). In a first aging treatment A1, the magnet body is heated at a first temperature T1. In a second aging treatment A2, the magnet body is heated at a second temperature T2. In a crack introduction heat treatment step A3, the magnet body is heated at a temperature T3 (crack introduction temperature T3). In an oxidation heat treatment step O, the magnet body is heated at an oxidation temperature To. It is preferable that the first temperature T1 is higher than the second temperature T2. It is preferable that the second temperature T2 is higher than the crack introduction temperature T3. It is preferable that the oxidation temperature To is higher than the crack introduction temperature T3 and is lower than the second temperature T2. When the relationship between the respective temperatures as described above is satisfied, the oxidized layer having a sufficient thickness tends to be formed, and the oxide phase in the oxidized layer tends to cover the grain boundary phase (for example, transition metal rich phase) in the magnet body. After the first aging treatment A1, the temperature of the magnet body may be lowered from T1 to a temperature lower than T2 (for example, room temperature). After the second aging treatment A2, the temperature of the magnet body may be lowered from T2 to a temperature lower than T3 (for example, room temperature) and then the cleaning step may be performed. After the crack introduction heat treatment step A3, the temperature of the magnet body may be lowered from T3 to a temperature lower than To (for example, room temperature).

The first temperature T1 of the first aging treatment may be 700 to 1000° C. Time t1 of the first aging treatment (time when the magnet body is continuously heated at the first temperature T1) may be 1 to 5 hours. When the first temperature T1 and the time t1 of the first aging treatment are out of the above range, the coercivity tends to be decreased.

The second temperature T2 of the second aging treatment may be 500 to 600° C. When the second temperature T2 is lower than 500° C., it is difficult to form the transition metal rich phase as compared with the R-rich phase, and form the oxidized layer and the oxide phase in the oxidation heat treatment step O. When the second temperature T2 exceeds 600° C., the transition metal rich phase tends to be excessively formed as compared with the R-rich phase, and the residual magnetic flux density (Br) of the sintered magnet tends to be decreased. Time t2 of the second aging treatment (time when the magnet body is continuously heated at the second temperature T2) may be 1 to 5 hours. As the time t2 of the second aging treatment is increased, the ratio of the number of grain boundary multiple junctions including the oxide phase among all the grain boundary multiple junctions exposed on the surface of the oxidized layer tends to be increased. When t2 is less than 1 hour, it is difficult to form the transition metal rich phase and form the oxidized layer and the oxide phase in the oxidation heat treatment step O. When t2 exceeds 5 hours, the transition metal rich phase tends to be excessively formed as compared with the R-rich phase, and the residual magnetic flux density (Br) of the sintered magnet tends to be decreased.

The crack introduction temperature T3 in the crack introduction heat treatment step may be 250 to 500° C., preferably 300 to 500° C., and more preferably 300 to 400° C. When the crack introduction temperature T3 is too low, cracks are hardly formed in the transition metal rich phase, and the transition metal rich phase is hardly oxidized in the oxidation heat treatment step. As a result, [O]/([R]+[T]+[Ga]+[O]) in the oxide phase tends to be less than 0.2. When the crack introduction temperature T3 is too high, a liquid phase is generated during the crack introduction heat treatment step, such that cracks are hardly formed. As a result, [O]/([R]+[T]+[Ga]+[O]) in the oxide phase tends to be less than 0.2. Time t3 of the crack introduction heat treatment step (time when the magnet body is continuously heated at the crack introduction temperature T3) may be 10 to 60 minutes. When t3 is too short, cracks are hardly formed in the transition metal rich phase, the transition metal rich phase is hardly oxidized in the oxidation heat treatment step, and the oxide phase is hardly formed. As a result, [O]/([R]+[T]+[Ga]+[O]) in the oxide phase tends to be less than 0.2. When t3 is too long, cracks excessively occur on the surface of the magnet body, and magnetic properties tend to be damaged.

The oxidation temperature To in the oxidation heat treatment step may be 300 to 450° C. As the oxidation temperature To is increased, the magnet body tends to be oxidized and the thickness of the oxidized layer tends to be increased. When the oxidation temperature To is too low, the transition metal rich phase 3 is hardly oxidized, such that it is difficult to form the oxide phase 3A and form the oxidized layer 6 having a sufficient thickness. When the oxidation temperature To is too high, the magnet body 4 itself tends to be excessively oxidized and the magnetic properties (for example, coercivity) of the sintered magnet 2 tend to be damaged, with the formation of the oxidized layer 6. Time <to> of the oxidation heat treatment step (time when the magnet body is continuously heated at the oxidation temperature To) may be 5 to 120 minutes. As the time <to> is increased, the oxidized layer 6 tends to be thick. When <to> is too short, the transition metal rich phase 3 is hardly oxidized, such that it is difficult to form the oxide phase 3A and form the oxidized layer 6 having a sufficient thickness. When <to> is too long, the magnet body 4 itself tends to be excessively oxidized and the magnetic properties (for example, coercivity) of the sintered magnet 2 tends to be damaged, with the formation of the oxidized layer 6.

In the oxidation heat treatment step, it is preferable to heat the magnet body in an atmosphere having an oxygen partial pressure of 0.1 to 20 kPa. As the oxygen partial pressure is increased, the magnet body tends to be oxidized and the thickness of the oxidized layer tends to be increased. When the oxygen partial pressure is too low, the transition metal rich phase 3 is hardly oxidized, such that it is difficult to form the oxide phase 3A and form the oxidized layer 6 having a sufficient thickness. When the oxygen partial pressure is too high, the magnet body 4 itself tends to be excessively oxidized and the magnetic properties (for example, coercivity) of the sintered magnet 2 tend to be damaged, with the formation of the oxidized layer 6. When the crack introduction heat treatment step is not performed, it is difficult to oxidize the transition metal rich phase and form the oxide phase even when the magnet body is heated in the atmosphere in which the oxygen partial pressure is high. As a result, [O]/([R]+[T]+[Ga]+[O]) in the oxide phase tends to be less than 0.2. The atmosphere of the oxidation heat treatment step may consist of at least one of oxygen and water vapor, and an inert gas. The inert gas may be a noble gas such as argon, or nitrogen.

As described above, it is preferable that the cleaning step is performed after the aging treatment step, the crack introduction heat treatment step is performed after the cleaning step, and the oxidation heat treatment step is performed after the crack introduction heat treatment step. However, the cleaning step may be performed after the aging treatment step, and the oxidation heat treatment step may be performed after the cleaning step without going through the crack introduction heat treatment. In the cleaning step, impurities such as rust (natural oxide film) are removed from the surface of the magnet body. In the cleaning step, for example, the surface of the magnet body may be cleaned with an acid solution. However, hydrogen generated from a non-oxidizing acid such as hydrochloric acid or sulfuric acid tends to be stored into the magnet body, and the magnet body tends to be brittle. Therefore, in order to suppress the generation of hydrogen from the acid, it is preferable to use a solution of nitric acid ($HNO_3$) which is an oxidizing acid.

In the cleaning step, ultrasonic cleaning may be performed following the acid cleaning. Impurities or acids used for cleaning are removed by the ultrasonic cleaning. In order to suppress the contamination or oxidation of the magnet body caused due to the ultrasonic cleaning, it is preferable to perform the ultrasonic cleaning in pure water. If the cleaning step is performed after the crack introduction heat treatment step, the cracked part formed in the crack introduction heat treatment step is dissolved and disappears due to the acid cleaning, such that it is difficult to form the oxidized layer having a sufficient thickness in the oxidation heat treatment step.

The sintered magnet according to this embodiment is obtained by the above-described method.

EXAMPLE

Hereinafter, the present invention will be described in more detail with reference to examples, but the present invention is not limited by these examples at all.

[Production of Sintered Magnet]

Example 1

Alloy A was prepared from a raw material metal as a raw material alloy by a strip casting method. The composition of the alloy A was adjusted to compositions shown in the following Table 1 below.

After hydrogen was stored in the raw material alloy described above, the raw material alloy was heated at 600° C. for 1 hour under an Ar atmosphere to be dehydrogenated, thereby obtaining a raw material alloy powder. That is, hydrogen pulverizing treatment was performed. Each step from the hydrogen pulverizing treatment to the following sintering step was performed under a nonoxidizing atmosphere having an oxygen concentration of less than 100 ppm.

Oleic acid amide was added to the raw material alloy powder as a pulverization aid, and these were mixed. The content of C in the final sintered magnet was adjusted by adjusting the addition amount of oleic acid amide. In the subsequent finely pulverizing step, the average particle size of the raw material alloy powder was adjusted to 3.5 μm using the jet mill. In the subsequent pressing step, the raw material alloy powder was filled in a mold. Then, the raw material powder was pressurized at 120 MPa while applying a magnetic field of 1200 kA/m to the raw material powder in the mold to obtain a green compact.

In the sintering step, the green compact was heated at 1050° C. for 4 hours in vacuum and then cooled to obtain a sintered body (magnet body).

After the dimension of the sintered body is adjusted, as the aging treatment step, the first aging treatment and the second aging treatment subsequent to the first aging treatment were performed. In any of the first aging treatment and the second aging treatment, the sintered body was heated in an Ar atmosphere. In any of the first aging treatment and the second aging treatment, the atmospheric pressure in the Ar atmosphere was an atmospheric pressure. After the second aging treatment, the sintered body was machined to adjust the dimension of the sintered body to 20 mm×10 mm×2 mm. In Example 1, the crack introduction heat treatment step was not performed.

In the first aging treatment, the sintered body was heated at 900° C. for 1 hour.

In the second aging treatment, the sintered body was heated at 500° C. Time t2 (time when the sintered body is continuously heated at 500° C.) of the second aging treatment is shown in the following Table 1.

In the cleaning step following the second aging treatment and the machining of the sintered body, the sintered body was immersed in an aqueous solution of nitric acid for 2 minutes. The concentration of nitric acid in the aqueous solution was 2 mass %. Subsequently, impurities such as nitric acid were removed from the sintered body by the ultrasonic cleaning using pure water.

In the oxidation heat treatment step subsequent to the cleaning step, the sintered body was heated at 350° C. for 60 minutes in the oxidation atmosphere. The oxygen partial pressure in the oxidation atmosphere was 1 kPa. The sintered body was naturally cooled after being heated for 60 minutes.

The sintered magnet of Example 1 was obtained by the above-described method. A plurality of sintered magnets of Example 1, which are exactly the same, were prepared for composition analysis and evaluation of corrosion resistance as described later.

Examples 2 to 11

In Examples 2 to 11, alloys shown in the following Tables 1 and 2 were prepared as raw material alloys. Time t2 of each second aging treatment in Examples 2 to 11 is shown in the following Table 2. In Examples 2 to 11, a sintered body was machined after first aging treatment and second aging treatment, a cleaning step was carried out after the machining of the sintered body, crack introduction heat treatment was performed after the cleaning step, and an oxidation heat treatment step was performed after the crack introduction heat treatment.

In each crack introduction heat treatment of Examples 2 to 11, respectively, the sintered body was heated for 10 minutes at a crack introduction temperature T3 shown in the following Table 2.

Except for the above matters, the sintered magnets of Examples 2 to 11, respectively, were prepared in the same manner as in Example 1.

Comparative Example 1

In Comparative Example 1, a cleaning step, a crack introduction heat treatment step, and an oxidation heat treatment step were not performed.

Except for the above matters, the sintered magnets of Comparative Example 1 were prepared in the same manner as in Example 1.

[Analysis of Cross Section of Sintered Magnet]

The compositions of the cross sections of the sintered magnets of each Example and Comparative Example 1 were analyzed by the following method.

The sintered magnet was cut perpendicularly with respect to its surface. The cross section of the sintered magnet was polished by ion milling to remove impurities such as oxide formed on the cross section. Subsequently, a region of a part of the cross section of the sintered magnet was analyzed with a scanning electron microscope (SEM) and an energy dispersive X-ray spectroscopy (EDS) apparatus. The analyzed region was a region positioned in the vicinity of the surface of the sintered magnet. In other words, the analyzed region was a region positioned in the vicinity of an outer edge (outer peripheral part) of the cross section of the sintered magnet. As the SEM, a Schottky scanning electron microscope "SU 5000" manufactured by Hitachi High-Technologies Corporation was used.

A photograph of the cross section of the sintered magnet of Example 4 of the present invention taken by the SEM is shown in FIG. 6.

As a result of the analysis of the cross section shown in FIG. 6, it was confirmed that the sintered magnet of Example 4 has the following characteristics.

As shown in FIG. 6, the sintered magnet was provided with the magnet body 4 and the oxidized layer 6 covering the entire magnet body.

The magnet body 4 contained Nd, Pr, Fe, Co, B, Ga, Cu, A1 and O. The magnet body 4 contained the plurality of main phase grains 8 and the grain boundary phase positioned between the main phase grains 8. The content (unit: atom %) of each element in the main phase grain 8 and the grain boundary phase was measured. The main phase grain 8 contained a crystal of $R_2T_{14}B$. R is Nd and Pr. T is Fe and Co. The grain boundary phase contained at least R, and the content of R in the grain boundary phase was higher than the content of R in the main phase grain 8. A part of the grain boundary phase contained R, T, and Ga, and was the transition metal rich phase 3 satisfying the following Formula (1'). A part of the grain boundary phase was the R-rich phase 5 described above.

$$0.3 \leq [R']/[T'] \leq 0.5 \quad (1')$$

[R'] is the content of R (Nd and Pr) in the grain boundary phase contained in the magnet body 4.

[T'] is the total content of Fe and Co in the grain boundary phase contained in the magnet body 4.

As shown in FIG. 6, the oxidized layer 6 included the oxidized main phase grains 8 and the plurality of oxide phases 3A positioned between the oxidized main phase grains 8. The oxide phase 3A contained R, T, Ga, and O. The oxide phase 3A satisfied the following Formulas (1) and (2).

$$0.3 \leq [R]/[T] \leq 0.5 \quad (1)$$

$$0.2 \leq [O]/([R]+[T]+[Ga]+[O]) \leq 0.7 \quad (2)$$

[R] is the content of R (Nd and Pr) in the oxide phase 3A.

[T] is the total content of Fe and Co in the oxide phase 3A.

[Ga] is the content of Ga in the oxide phase 3A.

[O] is the content of O in the oxide phase 3A.

As shown in FIG. 6, the oxide phase 3A contained in the oxidized layer 6 covered the grain boundary phase (transition metal rich phase 3) contained in the magnet body 4.

As shown in FIG. 6, the oxidized layer 6 also contained the above-described R-rich oxide phase 5A as the grain boundary phase positioned between the oxidized main phase grains 8. The grain boundary phase (R-rich phase 5) contained in the magnet body 4 was covered with the R-rich oxide phase 5A contained in the oxidized layer 6.

It was confirmed that all of the sintered magnets of Examples other than Example 4 also have the same characteristics as those of Example 4.

[Analysis of Surface of Sintered Magnet]

Figure 7:
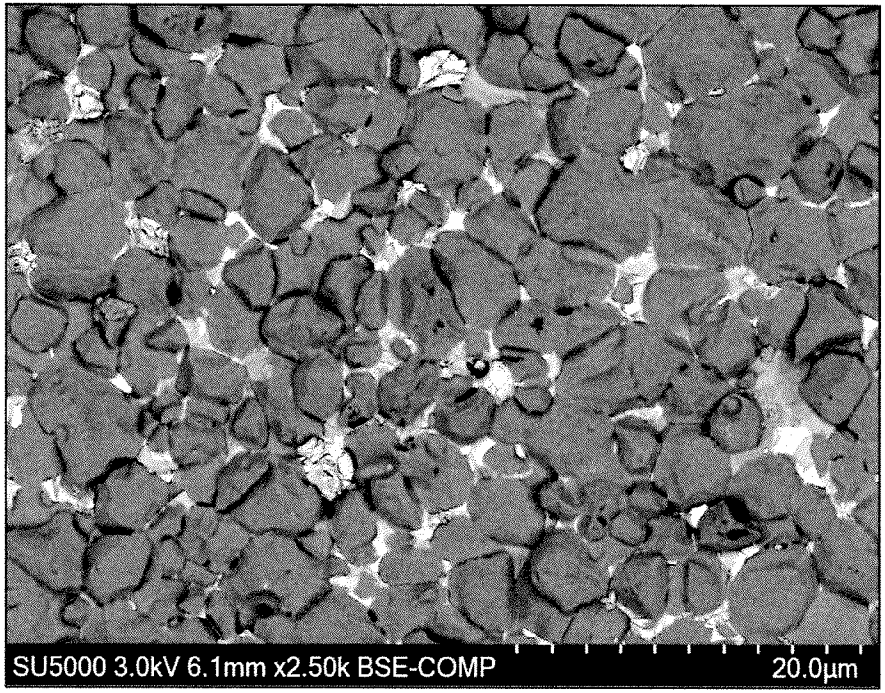
FIG. 7 is a photograph (photograph taken by a scanning electron microscope) of a surface of the R-T-B-based sintered magnet (oxidized layer) of Example 4 of the present invention.

The compositions of the outermost surfaces (that is, the surface of the oxidized layer) of the sintered magnets of each Example and Comparative Example 1 were individually analyzed by the above SEM and EDS using the following method. As an example, the photograph of the outermost surface of the sintered magnet of Example 4 taken by the SEM is shown in FIG. 7. In FIG. 7, the darker part is the oxidized main phase grain, and in FIG. 7, the lighter part is the grain boundary phase (grain boundary multiple junction) positioned between the main phase grains.

Details of measurement conditions of the EDS were as follows.

Live time: 60 seconds
Real time: 96.6 seconds
Process time: 6
Energy range: 20 keV
The number of channels: 2048
Energy per channel: 10 eV
Acceleration voltage: 15 kV
Magnification: 2500
Working distance: 11.5 mm
Sample tilt angle: 0°

The composition in one visual field enlarged 2,500 times of the outermost surface (the surface of the oxidized layer) of the sintered magnet was analyzed by the EDS. The content (unit: atom %) of O, Nd, Pr, Fe, Co, and Ga, respectively, in each of the grain boundary multiple junctions present in the visual field was measured by the EDS. Each grain boundary multiple junction present in the visual field is the grain boundary phase exposed on the surface of the oxidized layer and is a region surrounded by three or more oxidized main phase grains. [R]/[T] and [O]/([R]+[T]+[Ga]+[O]) at each grain boundary multiple junction were calculated based on these measurement results. Grain boundary multiple junctions where [R]/[T] is within the range of the following Formula (1) and [O]/([R]+[T]+[Ga]+[O]) is within the range of the following Formula (2) were found from all grain boundary multiple junctions present in the visual field. The number m of the grain boundary multiple junctions where [R]/[T] is within the range of the following Formula (1) and [O]/([R]+[T]+[Ga]+[O]) is within the range of the following Formula (2) was measured. In addition, the number M of all grain boundary multiple junctions present in the visual field was measured. Hereinafter, among the grain boundary multiple junctions included in the oxidized layer, the grain boundary multiple junction satisfying both the following formulas (1) and (2) is expressed as "T-rich grain boundary".

$$0.3 \leq [R]/[T] \leq 0.5 \quad (1)$$

$$0.2 \leq [O]/([R]+[T]+[Ga]+[O]) \leq 0.7 \quad (2)$$

An average value of [R]/[T] of all T-rich grain boundaries were calculated. The average value of [R]/[T] of Example 1 to 11, respectively, are shown in the following Tables 2 and 3. However, in the case of Comparative Example 1, since there was no grain boundary multiple junction (T-rich grain boundary) satisfying both the above Formulas (1) and (2), the average value of [R]/[T] at the grain boundary multiple junction satisfying only the above Formula (1) was calculated. The results of Comparative Example 1 are also shown in the following Tables 2 and 3.

The ratio m/M of the number m of T-rich grain boundaries to the number M of all grain boundary multiple junctions in the visual field was calculated. The m/M of Examples 1 to 11 and Comparative Example 1, respectively, is shown in the following Table 2.

The average value of the content of each of O, Nd, Pr, Fe, Co, and Ga in all T-rich grain boundaries was calculated. The average value of the content of each of O, Nd, Pr, Fe, Co, and Ga in each T-rich grain boundary of Examples 1 to 11 is shown respectively in the following Table 3. The compositions shown in the following Table 3 is an average composition of the oxide phases at the grain boundary multiple junctions of the oxidized layers of Examples 1 to 11, respectively. In the case of Comparative Example 1, since there was no grain boundary multiple junction (T-rich grain boundary) satisfying both the above Formulas (1) and (2), the average value of the content of each of O, Nd, Pr, Fe, Co, and Ga at the grain boundary multiple junction satisfying only the above Formula (1) was calculated. The results of Comparative Example 1 are also shown in the following Table 3.

[O]/([R]+[T]+[Ga]+[O]) of Examples 1 to 11 was respectively calculated from the average values of the content of O, Nd, Pr, Fe, Co, and Ga at the T-rich grain boundaries of Examples 1 to 11. [O]/([R]+[T]+[Ga]+[O]) of Example 1 to 11, respectively, are shown in the following Tables 2 and 3. In the case of Comparative Example 1, since there was no grain boundary multiple junction (T-rich grain boundary) satisfying both the above Formulas (1) and (2), [O]/([R]+[T]+[Ga]+[O]) of Comparative Example 1 was calculated from the average value of the content of each of O, Nd, Pr, Fe, Co, and Ga at the grain boundary multiple junction satisfying only the above Formula (1). The results of Comparative Example 1 are also shown in the following Tables 2 and 3.

[Evaluation of Corrosion Resistance]

The corrosion resistance of the sintered magnet of Examples 1 to 11 and Comparative Example 1, respectively, was evaluated by a saturated pressure cooker test (PCT). In the PCT, each sintered magnet was left for 1000 hours under the environment of 0.2 MPa, a temperature of 120° C., and a humidity of 100% RH. The decrease amount in a weight of each sintered magnet after 1000 hours was measured. A weight decrease amount ΔW (unit: mg/cm$^2$) per unit surface area of the sintered magnet of Examples 1 to 11, respectively, is shown in the following Table 2. As ΔW is decreased, the sintered magnet has the excellent corrosion resistance. As shown in the following Table 1, the sintered magnet of Comparative Example 1 was considerably corroded during the PCT and collapsed before the test time reaches 1000 hours.

TABLE 1

| | T.RE (Nd + Pr) | Nd | Pr | B | Co | Cu | Ga | Al | Fe |
|---|---|---|---|---|---|---|---|---|---|
| | Unit | | | | | | | | |
| | Mass % | Mass % | Mass % | Mass % | Mass % | Mass % | Mass % | Mass % | Mass % |
| Alloy A | 31 | 24.8 | 6.2 | 0.86 | 2 | 0.5 | 1 | 0.2 | 64.44 |
| Alloy B | 30.5 | 24.4 | 6.1 | 0.82 | 1 | 0.5 | 0.5 | 0.5 | 66.18 |
| Alloy C | 33 | 26.4 | 6.6 | 0.78 | 2 | 0.5 | 1 | 0.2 | 62.52 |
| Alloy D | 32 | 25.6 | 6.4 | 0.72 | 2 | 0.5 | 1.5 | 0.2 | 63.08 |
| Alloy E | 30 | 24 | 6 | 0.92 | 0.5 | 0.2 | 0.4 | 0.5 | 67.48 |
| Alloy F | 30.5 | 24.4 | 6.1 | 0.95 | 0.5 | 0.2 | 0.4 | 0.5 | 66.95 |

TABLE 2

| | Raw material alloy | First aging treatment | Second aging treatment t2 | Crack introduction heat treatment step T3 | Oxidation heat treatment step | [R]/[T] | [O]/([R] + [T] + [Ga] + [O]) | m/M | ΔW (mg/cm$^2$) |
|---|---|---|---|---|---|---|---|---|---|
| Comparative Example 1 | Alloy A | Performed | 30 Minutes | — | Not performed | 0.44 | 0.05 | 0.00 | Collapse |
| Example 1 | Alloy A | Performed | 30 Minutes | — | Performed | 0.37 | 0.23 | 0.28 | 0.72 |
| Example 2 | Alloy A | Performed | 30 Minutes | 300° C. | Performed | 0.32 | 0.59 | 0.28 | 0.24 |
| Example 3 | Alloy A | Performed | 30 Minutes | 400° C. | Performed | 0.34 | 0.52 | 0.25 | 0.22 |
| Example 4 | Alloy A | Performed | 30 Minutes | 500° C. | Performed | 0.40 | 0.21 | 0.39 | 0.68 |
| Example 5 | Alloy B | Performed | 30 Minutes | 300° C. | Performed | 0.39 | 0.48 | 0.42 | 0.18 |
| Example 6 | Alloy C | Performed | 30 Minutes | 300° C. | Performed | 0.43 | 0.51 | 0.45 | 0.2 |
| Example 7 | Alloy D | Performed | 30 Minutes | 300° C. | Performed | 0.45 | 0.49 | 0.48 | 0.17 |
| Example 8 | Alloy E | Performed | 30 Minutes | 300° C. | Performed | 0.45 | 0.51 | 0.15 | 0.28 |
| Example 9 | Alloy F | Performed | 30 Minutes | 300° C. | Performed | 0.37 | 0.46 | 0.12 | 0.25 |
| Example 10 | Alloy A | Performed | 60 Minutes | 300° C. | Performed | 0.48 | 0.45 | 0.56 | 0.18 |
| Example 11 | Alloy A | Performed | 120 Minutes | 300° C. | Performed | 0.47 | 0.51 | 0.68 | 0.16 |

TABLE 3

| | Unit: Atom % | | | | | | | | | — | — |
|---|---|---|---|---|---|---|---|---|---|---|---|
| | [O] | [Nd] | [Pr] | [Fe] | [Co] | [Ga] | [R] ([Nd] + [Pr]) | [T] ([Fe] + [Co]) | Total | [R]/[T] | [O]/([R] + [T] + [Ga] + [O]) |
| Comparative Example1 | 4.90 | 19.90 | 7.70 | 61.00 | 2.20 | 4.30 | 27.60 | 63.20 | 100.00 | 0.44 | 0.05 |
| Example1 | 22.80 | 14.20 | 5.80 | 52.70 | 1.80 | 2.70 | 20.00 | 54.50 | 100.00 | 0.37 | 0.23 |
| Example2 | 59.00 | 7.00 | 2.50 | 29.00 | 1.10 | 1.40 | 9.50 | 30.10 | 100.00 | 0.32 | 0.59 |
| Example3 | 52.30 | 8.30 | 3.40 | 33.20 | 1.30 | 1.50 | 11.70 | 34.50 | 100.00 | 0.34 | 0.52 |

TABLE 3-continued

| | Unit: Atom % | | | | | | | | | — | — |
|---|---|---|---|---|---|---|---|---|---|---|---|
| | [O] | [Nd] | [Pr] | [Fe] | [Co] | [Ga] | [R] ([Nd] + [Pr]) | [T] ([Fe] + [Co]) | Total | [R]/[T] | [O]/([R] + [T] + [Ga] + [O]) |
| Example4 | 20.90 | 15.50 | 6.10 | 52.40 | 2.00 | 3.10 | 21.60 | 54.40 | 100.00 | 0.40 | 0.21 |
| Example5 | 48.10 | 10.50 | 3.50 | 34.70 | 1.20 | 2.00 | 14.00 | 35.90 | 100.00 | 0.39 | 0.48 |
| Example6 | 51.20 | 10.20 | 3.90 | 31.50 | 1.10 | 2.10 | 14.10 | 32.60 | 100.00 | 0.43 | 0.51 |
| Example7 | 49.00 | 10.70 | 4.40 | 32.10 | 1.20 | 2.60 | 15.10 | 33.30 | 100.00 | 0.45 | 0.49 |
| Example8 | 50.80 | 10.70 | 4.00 | 31.60 | 1.00 | 1.90 | 14.70 | 32.60 | 100.00 | 0.45 | 0.51 |
| Example9 | 46.00 | 10.10 | 3.90 | 36.70 | 1.30 | 2.00 | 14.00 | 38.00 | 100.00 | 0.37 | 0.46 |
| Example10 | 45.10 | 12.50 | 4.60 | 34.60 | 1.20 | 2.00 | 17.10 | 35.80 | 100.00 | 0.48 | 0.45 |
| Example11 | 51.20 | 10.60 | 4.30 | 30.80 | 1.10 | 2.00 | 14.90 | 31.90 | 100.00 | 0.47 | 0.51 |

INDUSTRIAL APPLICABILITY

Since the R-T-B-based sintered magnet according to the present invention is excellent in the corrosion resistance, the R-T-B-based sintered magnet can be applied to, for example, a motor mounted on a hybrid vehicle or an electric vehicle.

REFERENCE SIGNS LIST

1*a*: Grain boundary multiple junction, 2: R-T-B-based sintered magnet, 2*cs*: Cross section of sintered magnet, 3: Transition metal rich phase, 3A: Oxide phase, 4: Magnet body, 5: R-rich phase, 5A: R-rich oxide phase, 6: Oxidized layer, 7: Cracks, 8: Main phase grain, A1: First aging treatment, A2: Second aging treatment, A3: Crack introduction heat treatment step, 0: Oxidation heat treatment step, T1: First temperature, T2: Second temperature, T3: Crack introduction temperature, To: Oxidation temperature, t1: Time for first aging treatment, t2: Time for second aging treatment, t3: Time for crack introduction heat treatment step.

What is claimed is:

1. An R-T-B-based sintered magnet comprising:

a rare earth element R, a transition metal element T, B, Ga, and O, wherein the R-T-B-based sintered magnet contains at least one of Nd and Pr as R, the R-T-B-based sintered magnet contains at least Fe of Fe and Co as T, the R-T-B-based sintered magnet includes a magnet body and an oxidized layer covering at least a part of the magnet body, the magnet body includes:

a plurality of main phase grains including a crystal of $R_2T_{14}B$, and a grain boundary phase positioned between at least two of the plurality of main phase grains and containing R, the oxidized layer includes a plurality of oxide phases containing R, T, Ga, and O, a content of R in the plurality of oxide phases is [R] atom %, a total content of Fe and Co in the plurality of oxide phases is [T] atom %, a content of Ga in the plurality of oxide phases is [Ga] atom %, and a content of O in the plurality of oxide phases is [O] atom %, the plurality of oxide phases satisfy:

$0.3 \leq [R]/[T] \leq 0.5$, and $0.2 \leq [O]/([R]+[T]+[Ga]+[O]) \leq 0.7$, and at least a part of the plurality of oxide phases included in the oxidized layer covers at least a part of the grain boundary phase included in the magnet body.

2. The R-T-B-based sintered magnet according to claim 1, wherein the plurality of oxide phases further satisfy:

$0.4 \leq [O]/([R]+[T]+[Ga]+[O]) \leq 0.7$.

3. The R-T-B-based sintered magnet according to claim 1, wherein the oxidized layer includes:

a plurality of oxidized main phase grains; and a plurality of grain boundary multiple junctions which are grain boundary phases surrounded by at least three of the plurality of oxidized main phase grains, and a ratio m/M of a number m of the plurality of grain boundary multiple junctions including at least a part of the plurality of oxide phases with respect to a total number M of the plurality of grain boundary multiple junctions exposed on a surface of the oxidized layer is 0.2 or more and 0.7 or less.

4. The R-T-B-based sintered magnet according to claim 1, wherein a content of R in the R-T-B-based sintered magnet is 30 mass % or more and 33 mass % or less, a content of B in the R-T-B-based sintered magnet is 0.72 mass % or more and 0.95 mass % or less, and a content of Ga in the R-T-B-based sintered magnet is 0.4 mass % or more and 1.5 mass % or less.

5. The R-T-B-based sintered magnet according to claim 1, wherein a content of R in the grain boundary phase included in the magnet body is [R'] atom %, a total content of Fe and Co in the grain boundary phase included in the magnet body is [T'] atom %, at least a part of the grain boundary phase included in the magnet body contains R, T, and Ga, and is a transition metal rich phase satisfying:

$0.3 \leq [R]/[T] \leq 0.5$, and at least a part of the transition metal rich phase is covered with at least a part of the plurality of oxide phases.

* * * * *